US007028959B2

(12) United States Patent
Schultz

(10) Patent No.: US 7,028,959 B2
(45) Date of Patent: Apr. 18, 2006

(54) ACCESSORY DEVICE

(76) Inventor: James Schultz, 211 Sandy Point La., Lake Zurich, IL (US) 60047

( * ) Notice: Subject to any disclaimer, the term of this patent is extended or adjusted under 35 U.S.C. 154(b) by 333 days.

(21) Appl. No.: 10/441,523

(22) Filed: May 20, 2003

(65) Prior Publication Data

US 2004/0232294 A1 Nov. 25, 2004

Related U.S. Application Data

(60) Provisional application No. 60/402,401, filed on Aug. 9, 2002.

(51) Int. Cl.
*A47B 96/06* (2006.01)

(52) U.S. Cl. ..... 248/230.1; 248/231.61; 248/479.1; 359/871

(58) Field of Classification Search ..... 248/230.1, 248/231.61, 231.85, 228.5, 230.5, 466, 475.1, 248/479.1, 484, 541; 359/871, 872; 108/158.11, 108/158.13

See application file for complete search history.

(56) References Cited

U.S. PATENT DOCUMENTS 2,854,893 A * 10/1958 Henshall ..... 248/475.1
3,977,645 A * 8/1976 Deely ..... 248/484
5,370,570 A * 12/1994 Harris ..... 446/227
6,220,717 B1 * 4/2001 Pastore ..... 359/871

* cited by examiner

*Primary Examiner*—Ramon O Ramirez
(74) *Attorney, Agent, or Firm*—Fitch, Even, Tabin & Flannery

(57) ABSTRACT

An accessory bracket is provided for mounting an accessory, such as a mirror or other instrument, close to the field of vision of a pilot of a boat, for instance. The bracket is mounted to a tower or other structure with a mount forming a clamp so that the bracket and an attached accessory are above the lines of sight of the pilot, thereby avoiding obstructing the pilot's view of the environment of the boat. The bracket includes an arm extending from the mount and a post extending from the arm. The mount is adjustable relative to the structure, and the bracket is accordingly adjustable. The accessory is mounted to the post and is adjustable relative to the post such that the accessory may rotate around the post and may pivot relative to the post. The arm may include a hinge for raising and lowering a portion of the arm and the attached post and accessory. These adjustment characteristics allow a pilot to position the accessory in a desired position dependent on the pilot's lines of sight so that the accessory remains close to the pilot's field of vision.

7 Claims, 3 Drawing Sheets

ACCESSORY DEVICE

CROSS-REFERENCE TO RELATED APPLICATION

This application claims benefit of U.S. Provisional Application No. 60/402,401, filed Aug. 9, 2002, entitled "Tower Mounted Mirror Bracket," and is related to U.S. Design patent application No. 29/182,104, filed May 20, 2003, entitled "Bracket."

FIELD OF THE INVENTION

The invention relates to an accessory bracket and, in particular, to a bracket for an accessory such as a mirror for a pleasure craft boat.

BACKGROUND OF THE INVENTION

Currently, pleasure craft boats such as speedboats, cruising vessels, and yachts are often used for watersports such as water skiing and wakeboarding. Typically, these watersports involve the boat traveling at a relatively high velocity. As is known, a boat is unable to simply apply brakes and stop. Instead, a boat must cut or reverse its throttle to reduce its linear forward velocity. In addition, a boat's ability to turn involves adjusting the direction of a rudder that creates a turning resistance against the water or involves adjusting the direction of the screws on the engine itself relative to the line of travel of the boat. In turning the boat, the turning radius of the boat is dependent upon the boat's speed. This is so because the adjusting of the rudder or direction of the engine screws turns the boat physically but does not directly change its path. The path is only altered by altering the momentum of the boat which is overcome by the resistance of the water against the keel or other hull shape of the boat.

During watersports such as water skiing or wakeboarding, a person on a ski or wakeboard, for instance, grips and holds a rope tethered to the boat. The speed of the boat allows the person holding onto the rope to be pulled along behind the boat while using the ski or wakeboard to ride generally atop the water's surface. The wakeboarder or skier is often not directly behind the boat, as the person will attempt to ride across the wake of the boat or over ramps and the like, as well as being to a side of the boat as the boat turns. During this activity, the boat pilot or another on-board person must watch the skiing or wakeboarding person whose only method for stopping is signaling the pilot or releasing the grip on the rope. If the person falls or otherwise releases the rope, the boat must return to the person for retrieval. Oftentimes, the only signs of the fallen person's presence in the water are the person's life vest and ski or wakeboard, for instance.

A boat pilot must be keenly aware of all surroundings and instruments. Because a boat operated at a high speed has attendant issues with its ability to stop and/or turn, the margin for error in reacting to another ship or craft, such as a much faster jet ski that may cross the boat's path, is relatively small. In addition, the pilot must be aware of a person, such as a skier or wakeboarder, who is being pulled by boat in order to recognize the person has fallen, quickly locate the person, and provide protection to and retrieve the otherwise stranded person.

Accordingly, there has been a need for an accessory bracket that mounts or holds accessories or instrumentation out of the forward and peripheral lines of sight of a boat pilot. Furthermore, there has been a need for a bracket for a rearview mirror which mounts out of these lines of sight while also providing a clear view of a person, such as a skier or wakeboarder, who is being pulled behind the boat.

SUMMARY OF THE INVENTION

In accordance with one aspect of the present invention, an accessory bracket is disclosed. Preferably, the bracket is used with a boat and mounted on a tower or other structure that extends above or to the side of a pilot so that the structure does not impede movement of the pilot or other occupants within the boat. The bracket, then, is mounted so that it does not impede the movement of a passenger in the boat while making the accessory available to the pilot. The bracket includes an adjustable mount for securing to the structure, and includes an arm and a post for adjustably securing an accessory thereto. The arm and the post may be separate, fixed components or may be formed integral. The mount may include a clamp member. As a typical structure is a tower formed of tubular members, the mount may form a cylindrical opening which secures around a portion of a tubular member of the tower.

The accessory bracket is adjustable by its mount to provide a variety of positions for locating the bracket on the boat structure. This allows the bracket to be adjusted according to the sight lines of a pilot so as not to obstruct these sight lines. In addition, the arm itself may have cooperating components, one component being secured at the mount and a second component moving relative to the secured component. The second component may have the post and accessory attached thereto. The two components of the arm may cooperate and move relative to each other with a hinge so that the second component may be raised or lowered depending on the pilot's sight lines.

The accessory itself is attached to the post and/or second component of a hinged arm. The accessory may rotate around by its attachment to adjust the accessory to a desired position. The accessory may be attached by a clamp that further includes a pivot with the accessory so that the position of the accessory may be further adjusted.

In one embodiment, the accessory may be a mirror assembly. The mirror assembly is then mounted above the view of the pilot so that the pilot can see in a direction rearward of the boat with an unobstructed view, and the mirror assembly is tilted downward so that a mirror attached thereto provides the pilot with the rearward view. The pivot of the clamp provides the ability to adjust the desired portion of the rearward view that is directed towards the pilot.

In this manner, the accessory such as a mirror or other instrument may be adjusted to provide the pilot with a clear view of the accessory. The pilot's position in the boat may shift left to right, and the pilot may be standing or sitting. Accordingly, the accessory bracket provides the pilot with the ability to adjust, according to need, the direction and position of the accessory bracket. The position of the accessory, such as a rearview mirror, is maintained close to the field of vision of the pilot without obstructing the pilot's view of the environment, and the viewing of the accessory is simple and unobstructed.

DESCRIPTION OF THE PREFERRED EMBODIMENTS

Figure 1:
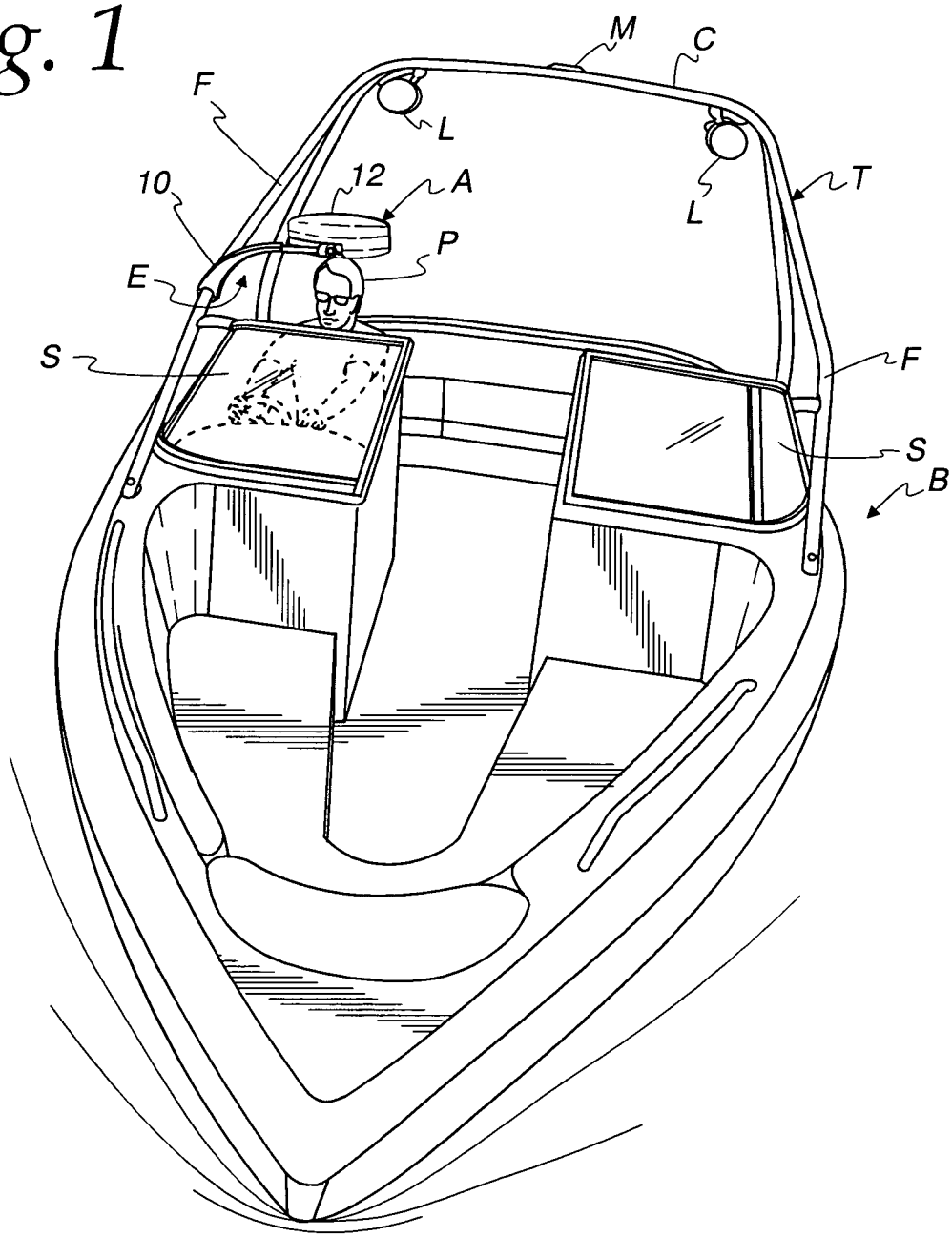
FIG. 1 is a first embodiment of an accessory bracket in a form of the present invention including an attached rearview mirror and being attached to a tower of a boat.
Figure 1A:
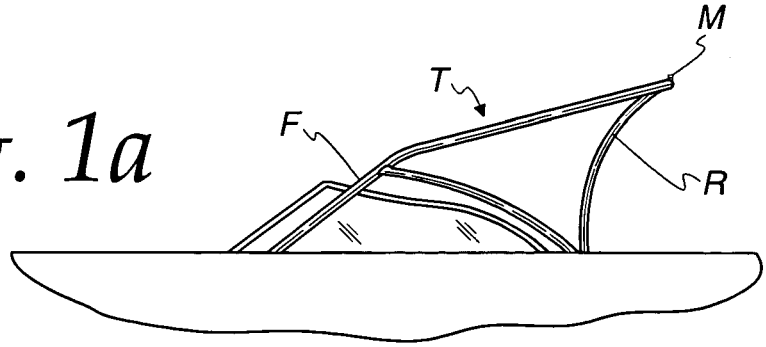
FIG. 1A is partial side elevation view of the boat and tower of FIG. 1.

Referring initially to FIG. 1, a representation of a boat B with an accessory bracket 10 of the present invention is depicted. The boat B is equipped with a tower T that may be equipped with various items such as satellite equipment, radar, or other antennae. As depicted, the tower T includes a pair of lights L and a mount M. The mount M is used, as an example, for attaching a rope (not shown) by which a wakeboarder may be towed. As can be seen in FIG. 1A, the tower T is a structure with a forward most point of front tubular members F mounted at approximately the middle of the boat B and angled toward the stern of the boat B as the front members rise from the boat B. The front members F meet rear tubular members R at a point above the stern of the boat where a crossbar C connects the members F, R.

A pilot P is standing at controls on the starboard side of the boat B. Ideally, the need of pilot P to look in a direction other than forward or peripherally across the surface of the water is minimized. When the pilot P reads the instruments on the boat or otherwise monitors the information necessary for operating the boat, only a slight movement of the pilot's eyes is preferable. As used herein, lines of sight or vision lines generally refer to a 360° environmental field view out-board from the boat B and includes from approximately horizontal to the surface of the water.

The accessory bracket 10 provides a mount for an accessory A above the plane of the standing pilot's sight. The bracket 10 is mounted to a front tubular member F of the tower T. As can be seen, the bracket 10 is mounted at a sufficient height so that the accessory is above the pilot's lines of sight. However, the portion of the front member F providing the sufficient height is not necessarily in front of the pilot's position at the controls. Accordingly, the bracket 10 is arcuate or curved so that a first, riser portion rises vertically and is directed somewhat towards the bow of the boat B, and a second part turns to form an extension in a direction lateral to the boat.

Furthermore, the bracket 10 is used to hold an accessory A such as a mirror assembly 12 including a mirror 42. In order to provide a large field of rear vision to the pilot P, the mirror 42 is large or oversized. For instance, the mirror may be larger than a foot (12 inches) across with a height of four or more inches. Therefore, the curved shaped, as well as a taper, of the bracket 10 enables the bracket 10 to support a large accessory A or mirror assembly 12 while simultaneously being configured to avoid unnecessary obstruction of a pilot's view.

When the boat is operated under certain conditions, it is necessary to protect the pilot's vision and view. Accordingly, a windshield section S is in front of the pilot, and a second windshield section S is provided on the port side of the boat B for a navigator, co-pilot, or passengers. The pilot P is generally either in a standing position with vision lines above the top of the windshield S, as depicted, or in a sitting position with vision lines through the windshield S. However, the instruments and controls of the boat are typically arranged below the windshield S. Accordingly, in order to read these, the eyes of a standing pilot P must deviate from forward lines of sight much greater than do the eyes of a sitting pilot.

Therefore, instruments or other devices for providing information to the pilot P during operation of the boat B may be provided as accessories A on the bracket 10. For instance, a digital readout may be provided indicating the speed of the boat B, or a warning may flash indicating shallow water is being approached, or a number of other status or operational indications such as fuel remaining or oil pressure may be made by the accessory A on the bracket 10.

As discussed above, a rearview mirror assembly 12 may be mounted on the bracket 10. In order to mount the mirror assembly 12 for viewing a wakeboarder being towed, for instance, the mirror must not be aligned with the pilot P and the wakeboarder. Otherwise, the pilot would only see their own image when trying to see the wakeboarder. As discussed above, the bracket 10 provides a mount for an accessory A such as the mirror assembly 12 allowing a clear view of a towed wakeboarder. The accessory A is adjustably secured above the sight lines of a standing pilot P while being viewable by the pilot P by looking in a direction only slightly above horizontal. As the wakeboarder or skier behind the boat moves laterally relative to the direction in which the boat is pointed, the pilot's view of the wakeboarder is not obscured by the body of the pilot or another occupant in the boat. It should be noted that the mirror assembly 12, or any other accessory A, may be multifunctional. That is, for instance, the mirror assembly 12 may also include a display section for other instrumentation such as an indicator of the boat's speed.

Figures 2, 3:
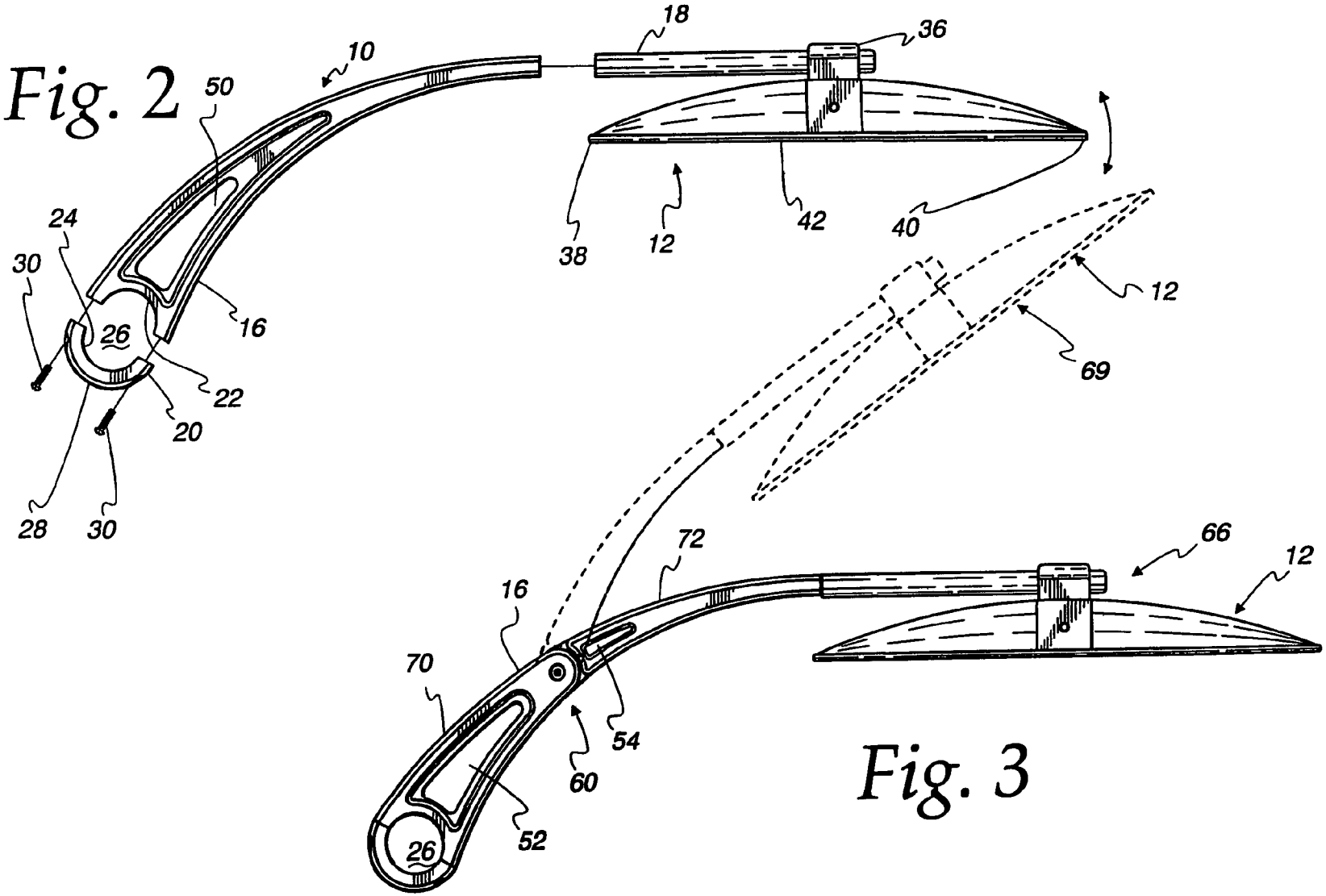
FIG. 2 is a partially exploded front elevation view of a second embodiment of an accessory bracket in a form of the present invention including an attached rearview mirror.
FIG. 3 is a front elevation view of a first position of a third embodiment of an accessory bracket in a form of the present invention including an attached mirror, a second position being depicted in phantom.

Referring now to FIG. 2, an embodiment of the bracket 10 is depicted with an accessory A in the form of the mirror assembly 12. The bracket 10 includes an arm section 16, a post section 18 attached to one end of the arm section 16, and a clamp section 20 attachable to the other end of the arm section 16. The arm section 16 includes a hemispherical surface 22 at the end attachable to the clamp section 20, and the clamp section 20 has a hemispherical surface 24 facing the hemispherical surface 22 of the arm section 16. The hemispherical surfaces 22,24 form a mount in the form of a cylindrical port 26 when the arm section 16 and clamp section 20 are attached. As noted earlier, the bracket 10 may be mounted to the tower T, itself typically a structure including tubular members. The geometry of the cylindrical port 26 is constructed so as to fit around a tubular member of the tower T, preferably with approximately ⅛" clearance between the cylindrical port 26 and the tubular member of the tower T. A set screw (not shown) may be inserted into a portion of the bracket 10 (for example, at point 28) such that the set screw drives into a tubular member of the tower T to secure the bracket 10 thereto. As depicted, the clamp section 20 is attached to the arm section 16 with bolts or screws 30, though any other fastener or structure for connecting these may be employed. For instance, a quick-release clamp (not shown) may be used so that the position of the bracket 10 may be released and re-secured without employing the set screw. In addition, other structure may be provided whereby the bracket 10 may be adjustably secured to a portion of the boat B so that the bracket 10 and the accessory A are above the lines of sight of a pilot P.

The arm section 16 is preferably secured to or formed integral with the post section 18. The arm section 16 has overall cross-sections generally of a rectangle, while the post section 18 has a cross-section generally of a circle. The post section 18 has the mirror assembly 12 secured thereto in the present embodiment. The mirror assembly 12 is equipped with a clamp 36 that may be tightened with a bolt (not shown) so that it is held in place frictionally. However, the clamp 36 is made of a polymeric material so that the mirror assembly 12 may be rotated manually around the post section 18 to a proper alignment for the pilot's rearward viewing. The clamp 36 is further secured by a pivot (not shown) to the back of the mirror assembly 12 so that, in the pilot's view, edges 38 and 40 of the mirror assembly 12 may be adjusted fore and aft. The mirror assembly 12 includes a mirror plate 42 for displaying a rearward view.

In FIG. 2, a cut out 50 is depicted in the arm section 16. The cut out 50 reduces the weight of the bracket 10 and provides an aesthetic quality to the bracket. In a further embodiment depicted in FIG. 3, the bracket 10 has a pair of cut outs 52 and 54 on either side of a hinge 60.

As discussed above, the pilot P may be either standing or sitting. Accordingly, the bracket 10 is provided with the hinge 60, thereby permitting the bracket 10, while secured about the tubular members of the tower T, to be raised or lowered, depending on both the stance and the height of the pilot P. As the bracket 10 permits other accessories, not simply a rearview mirror assembly 12, to be mounted thereon, the use of the bracket 10 may provide an instrument or accessory redundant to those located below the windshield S, or may obviate the need for particular accessories to be located below the windshield S. FIG. 3 depicts the mirror assembly 12 in a lower position 66 and, in phantom lines, in an upper position 69 by rotating around the hinge 60.

Figure 4:
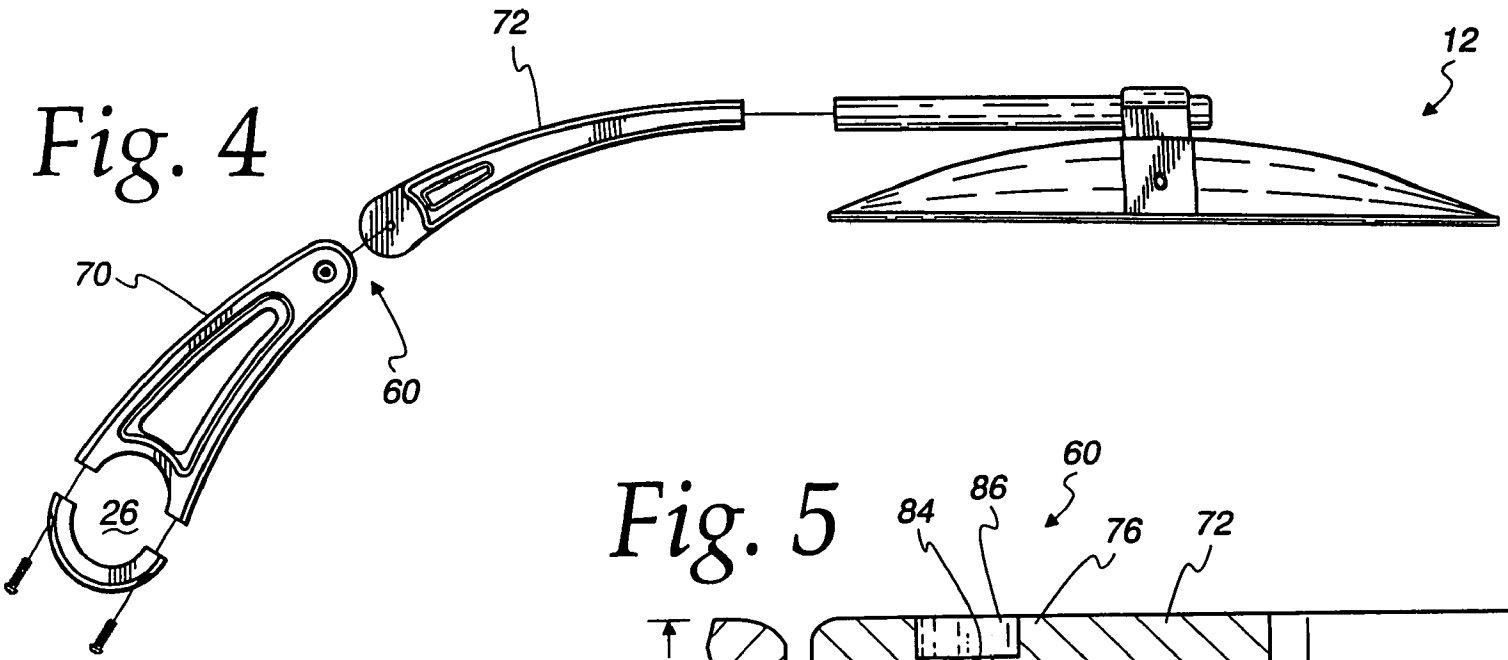
FIG. 4 is a partially exploded front elevation view of the accessory bracket of FIG. 3.
Figure 5:
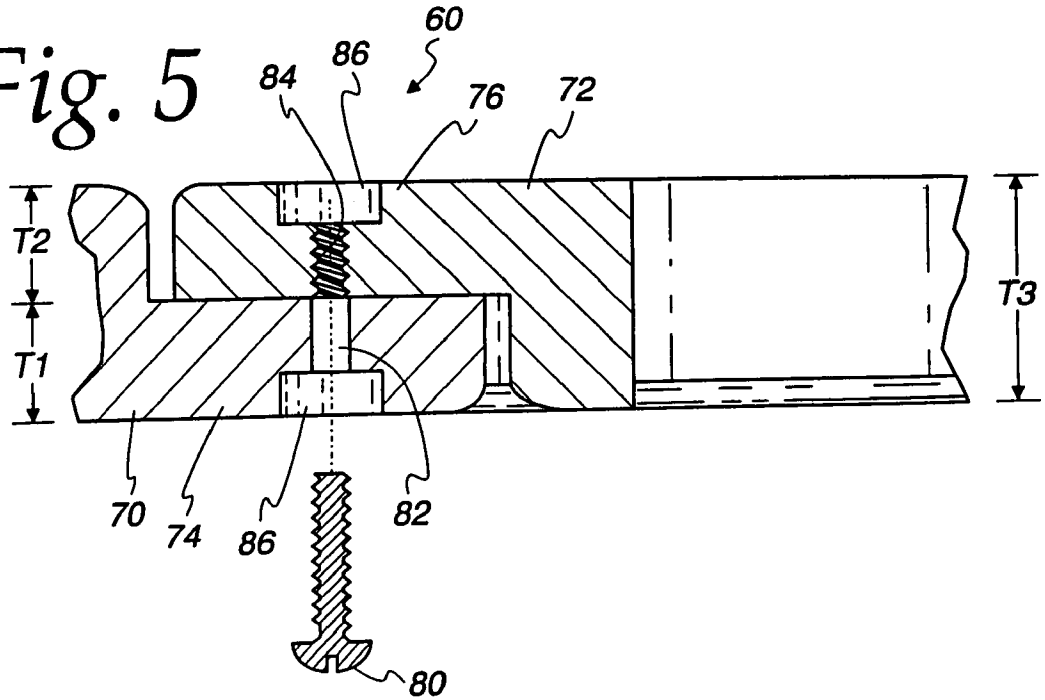
FIG. 5 is a partial cross-sectional view of a joint of the embodiment of FIG. 3.

As can be seen in FIGS. 3–5, the arm section 16 is comprised of a secure extension 70 and a rotator extension 72 is rotatable relative to the secure extension 70 by the hinge 60. The secure extension 70 has a first end forming the cylindrical port 26 and secured to the tower T and a second, mating end 74, and the rotator extension 72 has the mirror assembly 12 attached at a first end and a second, mating end 76 that mates with the mating end 74 of the secure extension 70. Each mating end 74, 76 of the extensions 70, 72 that has a smaller thickness T1, T2, respectively. Therefore, when the mating ends 74, 76 are placed together, the combined thickness T3 is generally that of the arm section 16 overall. The mating ends 74, 76 are held together with a bolt 80 or other fastener which passes through a cylindrical bore 82 of one of the mating ends 74, 76 and into a threaded bore 84 of the other mating end 76,74. The hinge 60 may further have a polymeric (such as nylon) bushing or washer (not shown) between the mating ends 74,76 to facilitate rotation of the extensions 70, 72. The mating ends 74,76 may additionally have recesses 86 for counter-sinking the head 88 of the bolt 80 or a nut (not shown) for receiving the bolt 80.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An accessory bracket comprising:

a mount adjustably connected to a boat such that an accessory is adapted to be above a line of sight of a boat pilot;

an arm extending from the mount wherein the mount includes a clamp member secured to the arm;

a post extending from the arm for adjustably securing the accessory thereto and above the lines of sight of the boat pilot wherein the clamp member and arm form a cylindrical opening, and a cylindrical portion of the boat is located in the opening when the accessory bracket is connected to the boat.

2. The accessory bracket of claim 1 wherein the boat portion to which the accessory bracket is mounted is a portion of a tower.

3. The accessory bracket of claim 1 wherein the arm includes a first portion for forming the cylindrical opening, and a second portion extending from the first portion.

4. The accessory bracket of claim 1 wherein the arm includes a first portion for forming the cylindrical opening, and a second portion attachable to the first portion.

5. An accessory bracket comprising:

a mount adjustably connected to a boat such that an accessory is adapted to be above a line of sight of a boat pilot;

an arm extending from the mount;

a post extending from the arm adjustably securing the accessory thereto and above the line of sight of the boat pilot wherein the accessory is adjustable to adjust the position of the accessory at a desired position and the post has a cylindrical portion to which the accessory is secured, and the accessory includes a clamp for rotationally securing to the cylindrical portion of the post.

6. The accessory bracket of claim 5 wherein the clamp includes a pivot for adjusting the position of the accessory to the desired position.

7. The accessory bracket of claim 6 wherein the accessory is a mirror providing a view rearward of the boat.

* * * * *